US011542789B2

(12) United States Patent
Tang et al.

(10) Patent No.: US 11,542,789 B2
(45) Date of Patent: Jan. 3, 2023

(54) CAVITY CREATION TOOL BY CRUSHING WITH MULTI-STAGE CONTROLLABLE WATER JET FOR NATURAL GAS HYDRATE DEVELOPMENT

(71) Applicants: Southwest Petroleum University, Chengdu (CN); Southern Marine Science and Engineering Guangdong Laboratory (Zhanjiang), Zhanjiang (CN)

(72) Inventors: Yang Tang, Chengdu (CN); Peng Zhao, Chengdu (CN); Guorong Wang, Chengdu (CN); Jinhai Zhao, Chengdu (CN); Qingyou Liu, Chengdu (CN); Jinzhong Wang, Chengdu (CN); Guangjie Yuan, Chengdu (CN); Yufa He, Zhanjiang (CN); Qingping Li, Zhanjiang (CN); Xushen Li, Zhanjiang (CN); Xiaoyu Fang, Zhanjiang (CN); Zeliang Li, Chengdu (CN); Xin Jing, Chengdu (CN)

(73) Assignees: Southwest Petroleum University, Chengdu (CN); Southern Marine Science and Engineering Guangdong Laboratory (Zhanjiang), Zhanjiang (CN)

( * ) Notice: Subject to any disclaimer, the term of this patent is extended or adjusted under 35 U.S.C. 154(b) by 0 days.

(21) Appl. No.: 17/537,447

(22) Filed: Nov. 29, 2021

(65) Prior Publication Data

US 2022/0268132 A1 Aug. 25, 2022

(30) Foreign Application Priority Data

Feb. 24, 2021 (CN) ..... 202110209892.6

(51) Int. Cl.
*E21B 41/00* (2006.01)
*E21B 34/10* (2006.01)

(52) U.S. Cl.
CPC ..... *E21B 41/0099* (2020.05); *E21B 34/10* (2013.01); *E21B 41/0078* (2013.01)

(58) Field of Classification Search
CPC ..... E21B 17/18; E21B 43/112; E21B 7/185; E21B 41/0099; E21B 41/0078
See application file for complete search history.

(56) References Cited

U.S. PATENT DOCUMENTS

2020/0291754 A1 9/2020 Zhao et al.

FOREIGN PATENT DOCUMENTS

| | | | |
|---|---|---|---|
| CN | 106761588 | A | 5/2017 |
| CN | 107642346 | A | 1/2018 |
| CN | 108375660 | A | 8/2018 |
| CN | 108468534 | A | 8/2018 |

(Continued)

*Primary Examiner* — Robert E Fuller

(57) ABSTRACT

A cavity creation tool by crushing with multi-stage controllable water jet, it is used in natural gas hydrate development and mainly consists of an inner tube upper joint, an inner tube lower joint, an intermediate sleeve, an inner structure consisting of a coaxial throttle push rod, an outer layer sleeve, an outer layer structure consisting of a supporting ring, a jet head mounted to the intermediate sleeve and threading the outer layer sleeve, and a jet crushing structure consisting of a single-stage telescopic jet head and a two-stage telescopic jet head.

4 Claims, 9 Drawing Sheets

(56) References Cited

FOREIGN PATENT DOCUMENTS

| | | | | | |
|---|---|---|---|---|---|
| CN | 110029983 | A | | 7/2019 | |
| CN | 110080726 | A | * | 8/2019 | ..... E21B 17/18 |
| CN | 111021958 | A | | 4/2020 | |
| CN | 211777348 | U | | 10/2020 | |

* cited by examiner

CAVITY CREATION TOOL BY CRUSHING WITH MULTI-STAGE CONTROLLABLE WATER JET FOR NATURAL GAS HYDRATE DEVELOPMENT

CROSS-REFERENCE TO RELATED APPLICATIONS

This application claims priority to Chinese Application No. 202110209892.6, filed on Feb. 24, 2021, entitled "A cavity creation tool by crushing with multi-stage controllable water jet for natural gas hydrate development". These contents are hereby incorporated by reference.

TECHNICAL FIELD

The present disclosure relates to the exploitation area of natural gas hydrate, more specifically a cavity creation tool by crushing with multi-stage controllable water jet for natural gas hydrate development.

BACKGROUND

Natural gas hydrates are also known as "flammable ice", which is "cage compound" formed by methane-based hydrocarbon gas and water under certain temperature pressure conditions. The test-mining exploration shows that a natural gas hydrate reserve with calorific values equivalent to 100 billion tons of petroleum exists in South China Sea. However, at present it still remains a worldwide problem how to achieve efficient and controllable commercial exploitation of hydrates.

At present, the pressure drop method, the hot injection method, the chemical inhibitor method and CO2 replacement method among the exploitation methods of hydrates in the world merely perform short term pilot productions on natural gas hydrates. Moreover, natural gas hydrates in the South China Sea is mainly based on unstratified rock natural gas hydrates and characterized by having abundant reserves, while having a low bonding strength and thus poor stability. Once changes to the temperature and pressure conditions occur in the region, it may cause massive decomposition, gasification and free release of the submarine unstratified rock natural gas hydrates, which will result in natural disasters and submarine environment destruction. Therefore, considering the characteristics and distribution of natural gas hydrates in the South China Sea, the exploitation of natural gas hydrates generally performs as follows: firstly drilling into a predetermined position by using a drill to form a pilot hole, and then laying down an exploitation tool through a back-pullable well, the exploitation tool can be transported and pulled back through the back-pullable well, such that the exploitation tool is configured for cavity creation and recycling by submerging and jet crushing on the surrounding unstratified rock natural gas hydrates layer during the pulling back procedure; and after separating hydrates from soils and sands through a separator, discharging soils and sands out of backfill strata by the cavity creation tool using natural gas hydrate crushing and a drill, which maintains the stability of the stratum structure.

That the natural gas tool used in the current natural gas hydrate exploitation cannot meet functions of crushing and creating cavity, recycling and soils and sands backfilling by for hydrates with high efficiency, is mainly reflected in the following aspects:

(1) the current natural gas hydrate jet crushing tool can only achieve jet crushing under specific flow rate with specific number of sprinklers, which cannot achieve jet crushing under multi-flow rate levels with variable and controllable number of sprinklers.

(2) in the process of crushing and exploiting natural gas hydrates, it needs to ensure the maximum jet pressure in order to obtain the maximum jet crushing radius, which means the axial drilling fluid path needs to be strictly blocked during the jet crushing process. But the existing jet crushing device achieves sealing by extrusion on the axial flow path, which will inevitably result in axial leakage during jet crushing and poor sealing effect.

(3) during the exploitation of natural gas hydrates, in order to ensure the stability of submarine strata after jet crushing hydrates, it is necessary to backfill soils and sands in situ after separating the recycled hydrates and soils and sands in a separator. Therefore, the jet crushing device should be provided with a separate soils and sands backflow passage. But the existing jet crushing tool does not have a soils and sands backflow passage.

(4) when the pull-back exploitation tool string perform jet crushing during the exploitation of natural gas hydrates, the front end jet head of the jet crushing tool is in a submerged jetting state, i.e. the outer portion of the head is in a state covered by weak cemented hydrates and soils and sands. However, the telescopic head structure and arrangement method designed for the sake of pursuing larger crushing radius for the existing jet crushing tool will result in that telescopic head will immediately protrude after the jet crushing tool initiates and the protruded head will be blocked by soils and sands, which will severely influence the pull-back of exploitation tool string and greatly decrease the exploitation efficiency.

SUMMARY OF THE INVENTION

In order to solve the above problems, the present disclosure provides a cavity creation tool by crushing with multi-stage controllable water jet for natural gas hydrate development, which is provided with an intermediate sleeve, a C-shaped ring and a coaxial throttle rod acting as an open angle regulation device for the jet crushing flow. Given the feature that the C-shaped ring with a contraction property is in an inclined slot with different angles on the intermediate sleeve and the pushing force that the coaxial throttle push rod needs to push the C-shaped ring is different, the flow of the drilling well fluid pumped from the ground is regulated to change the pushing force in the orifice of the coaxial throttle push rod, pushing the coaxial throttle push rod and the C-shaped ring in the movement along the axial direction, further changing the number of jet heads opened simultaneously with the device and realizing the jet crushing function under different flows, which solves the problem that only a single-level jet crushing flow exists in the current jet crushing device; the present disclosure is provided with a sealing structure with a poppet valve end face. The replacement of the extrusion sealing structure in the existing jet crushing tool with the sealing structure with a poppet valve end face can ensure complete blocking of the axial flow path during jet crushing, which solves the problem of the poor extrusion sealing of the current jet crushing tool; the present invention is provided with a hydrate suction port, a recycling passage and a soils and sands discharge passage. The crushed hydrate mixture reaches the separator through a suction port and a recycling passage and backfill of soils and sands in situ can be realized when soils and sands separated from the hydrate mixture in a separator reaches the drill end through the soils and sands discharge passage and get discharged from soils and sands discharge port, which solves the defect that the existing crushing tool does not have soils and sands discharging function; The present invention is provided with three jet crushing heads, i.e. a jet head, a single-stage telescopic jet head and a two-stage telescopic jet head, which are sequentially arranged in a trapezoid shape. In the stage where the jet crushing device pulls back and jet crushes, the jet head in the front end is broken to from certain cavity, thereby the single-stage telescopic jet head and the two-stage telescopic jet head have enough space to protrude the head so as to achieve larger crushing radius for hydrates, which solves the problem that the protruding head of the jet crushing tool is severely blocked by soils and sands and the pull-back efficiency of tools is greatly influenced.

The technical solution of the present invention is as follows:

A cavity creation tool by crushing with multi-stage controllable water jet for natural gas hydrate development, wherein an inner tube upper joint, an inner tube lower joint, an intermediate sleeve, a C-shaped ring, a coaxial throttle push rod and a sealing structure with a poppet valve end face consist of the inner structure of the hydrate crushing and recycling device. The upper end of the intermediate sleeve and the inner tube upper joint is in a plug-in connection and the intermediate sleeve and the inner tube lower joint are in a plug-in connection. The sealing structure with a poppet valve end face is mounted to the inner tube lower joint. The C-shaped ring is mounted to the coaxial throttle push rod to realize the axial and longitudinal fixation of the coaxial throttle push rod in the intermediate sleeve; The outer layer sleeve and the supporting ring consist of the hydrate crushing and recycling device, wherein the outer layer is provided with a first layer sleeve, a second layer sleeve, an outer thread I located in the upper portion of the first layer sleeve, an inner thread II located at the lower portion of the first layer sleeve, four evenly distributed suction ports located at the lower portion of the outer layer sleeve and penetrating the first layer sleeve and the second layer sleeve and four evenly distributed flow holes located between the first layer sleeve and the second layer sleeve. The outer layer sleeve is connected to the inner tube lower joint through the inner thread II located at the lower portion of the first layer sleeve and the supporting ring is connected to the upper portion of the first layer sleeve through screw threads, which realizes the support between the first layer sleeve and the second layer sleeve; The jet head, the single-stage telescopic jet head, the two-stage telescopic jet head consist of the crushing device of the tool. The jet head housing I, the spring II, the throttle nozzle I and the block I consist of the single-stage telescopic jet head. The throttle nozzle I is disposed within the jet head housing I. The spring II is mounted between the throttle nozzle I and the jet head housing I and the block I is screwed into the jet head housing I through screw threads. Thus, the assembly of the single-stage telescopic jet head is completed; The jet head housing II, the spring III, the throttle nozzle II, the spring IV, the throttle nozzle III, the plug and the block II consist of the two-stage telescopic jet head. The throttle nozzle II is disposed within the jet head housing II. The spring III is mounted between the throttle nozzle II and the jet head housing II. The stop II is screwed into the jet head housing II through screw threads. The spring IV is mounted within the throttle nozzle II. The throttle nozzle II is mounted within the throttle nozzle II. The plug is connected to the throttle nozzle III through screw threads to get screwed to the throttle nozzle III. Thus, the assembly of the two-stage telescopic jet head is completed.

The sealing structure with a poppet valve end face consists of the poppet valve cover, the spring I and the axial rod, and the mounting method is as follows: the axial rod passes through the through hole of the inner tube lower joint from the bottom; the spring I and the poppet valve cover are placed into the arcuate cavity from the upper portion of the inner tube lower joint; the axial rod and the poppet valve cover are connected by screwing the internal hexagonal groove on the poppet valve cover through a tool; thus the mounting of the sealing structure with a poppet valve end surface is completed.

The intermediate sleeve is provided with the plug-in female connector I, the 25° inclined slot, circumferentially evenly distributed six threaded holes I, the 30° inclined slot, circumferentially evenly distributed six threaded holes II, the 40° inclined slot, circumferentially evenly distributed six threaded holes III, the 50° inclined slot, circumferentially evenly distributed six threaded holes IV, the 60° inclined slot and the sealing groove I.

Three heads, i.e. the jet head, the single-stage telescopic jet head and the two-stage telescopic jet head, are mounted as follows: the internal hexagonal groove on the jet head housing is screwed through a tool and it is connected to the intermediate sleeve through screw threads at the bottom of the jet head housing, wherein the jet head is mounted on the threaded hole I and the threaded hole II, the single-stage telescopic jet head is mounted on the threaded hole III and the two-stage telescopic jet head is mounted on the threaded hole IV.

The outer layer sleeve is provided with the tube threaded male connector located on the upper portion of the first layer sleeve, the plug-in male connector located at the upper portion of the second layer sleeve and the plug-in female connector located at the lower portion of the outer layer sleeve.

The jet head housing I is provided with the internal hexagonal groove I and the jet head housing II is provided with the internal hexagonal groove II.

Beneficial effects of this disclosure are (1) the present disclosure can achieve that the controllable jet crushing head under different flow levels and different amounts performs the cavity creation by jet crushing natural gas hydrates.

(2) the present disclosure uses the sealing structure with a poppet valve end face to block the drilling liquid axial flow path during the jet crushing process, which can completely block the drilling liquid axial flow path and make sure that the jet crushing pressure will not decrease due to leakage.

(3) the present disclosure is provided with a hydrate suction port, a lifting passage and a soils and sands discharge passage. Soils and sands pass through the soils and sands discharge passage and is discharged through the sand discharge port on the drill end after separating the hydrates and soils and sands mixture in a separator, achieving the backfilling in situ of soils and sands.

(4) the jet crushing head in the present disclosure is in various echelon arrangements such that the hydrate exploitation tool string will not be blocked by soils and sands when performing the submerging and jet crushing during pull-back process, which can improve the crushing efficiency. And the single-stage telescopic head and the two-stage telescopic head can achieve greater crushing radius under the submerging and jet crushing state; the crushing and exploiting efficiency of natural gas hydrates can be improved.

Figure 1:
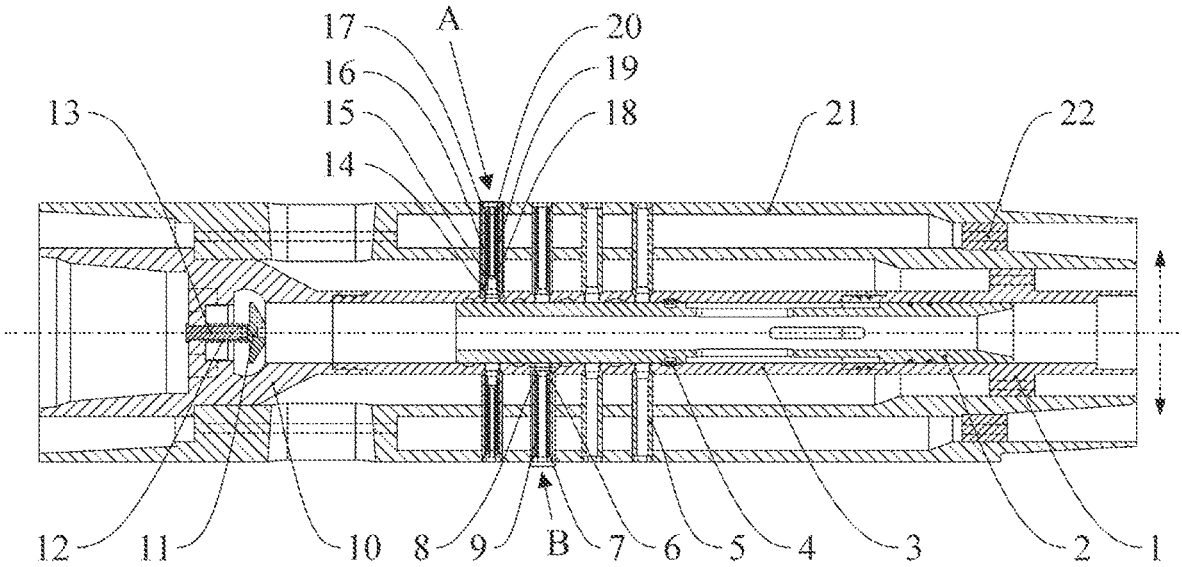
FIG. 1 is a two dimensional view of the overall structure in the present disclosure.
Figure 2:
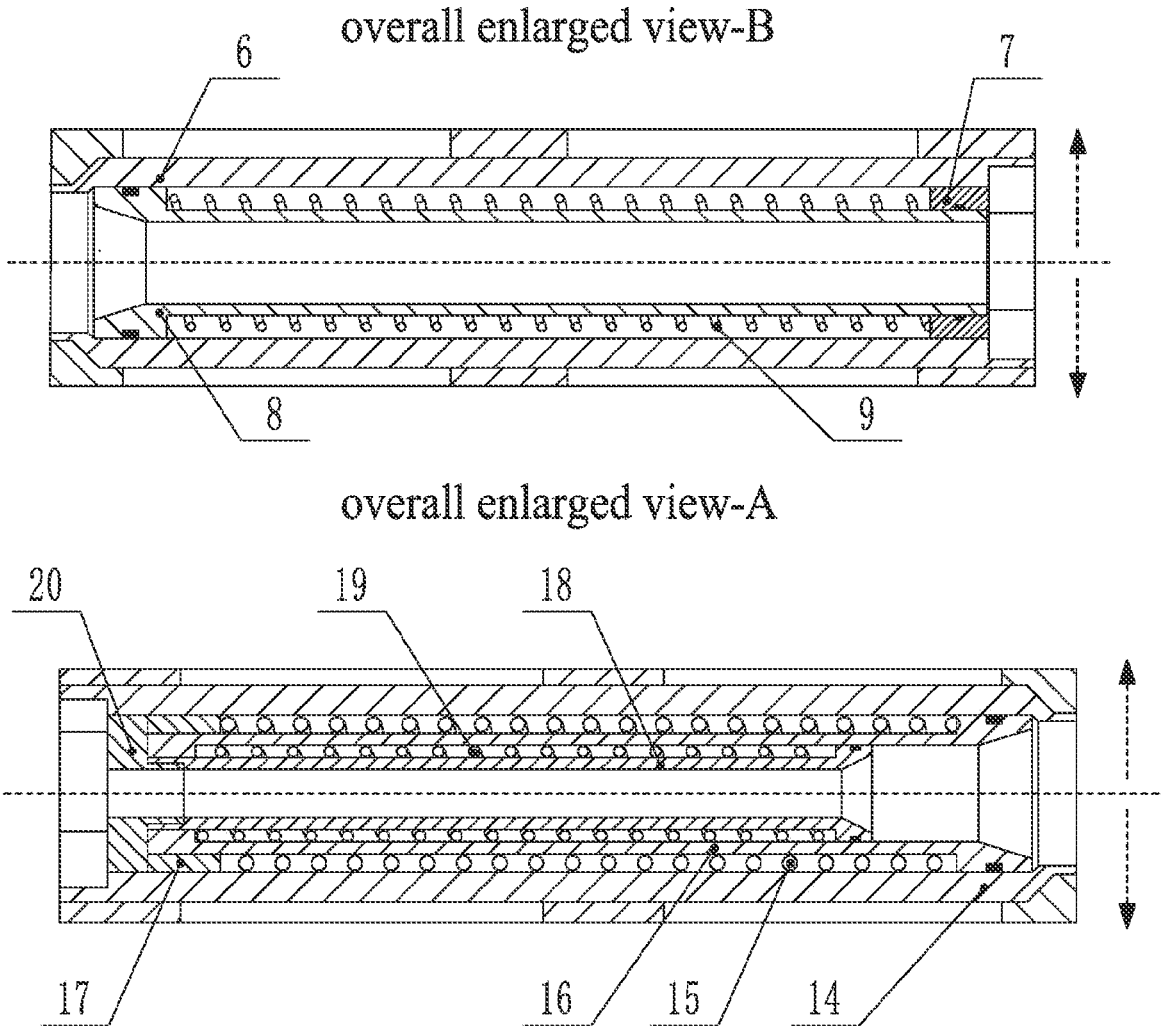
FIG. 2 is an overall enlarged view of A and B position in FIG. 1.
Figure 3:
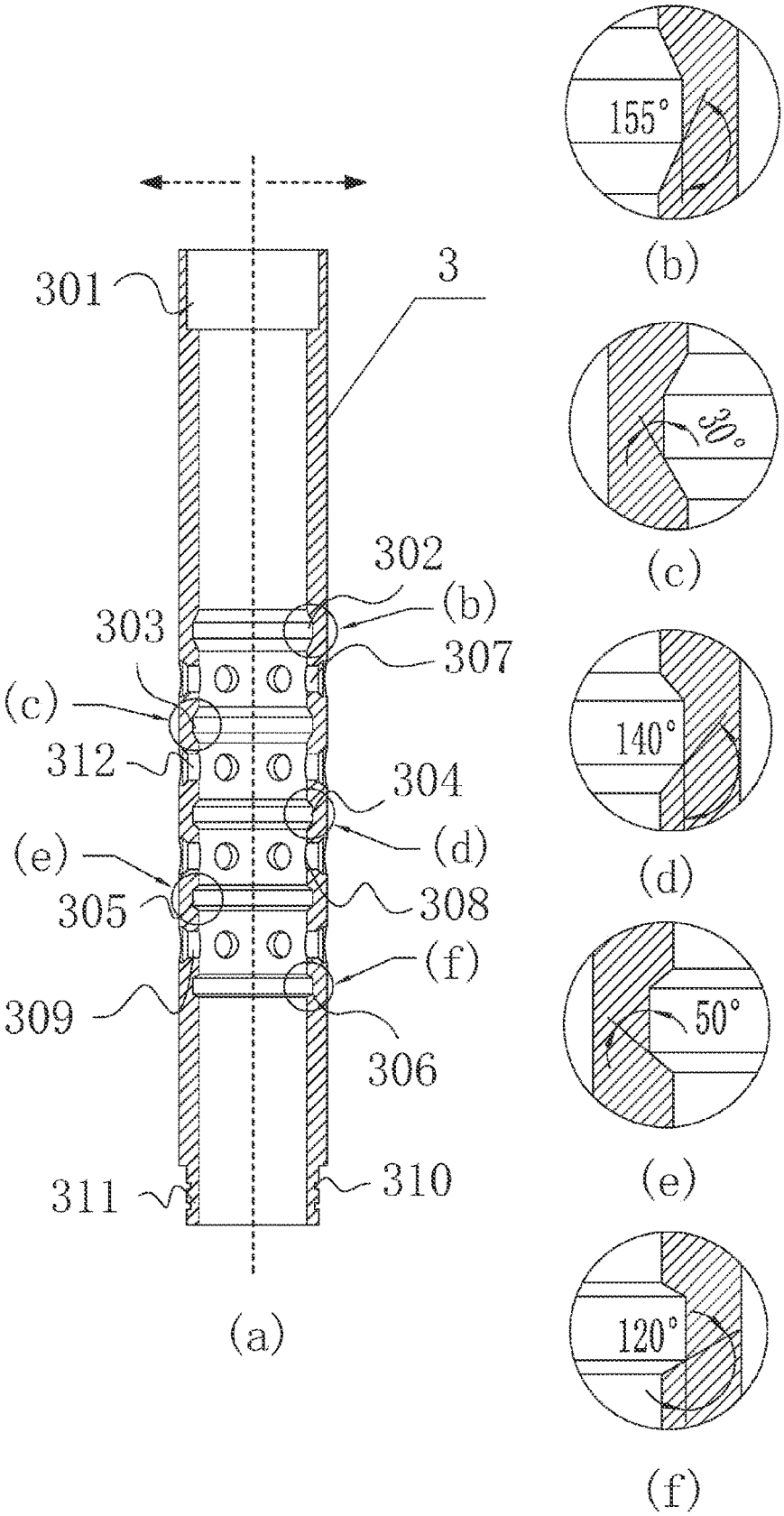
FIG. 3(*a*) is a two dimensional view of the intermediate sleeve in the present disclosure, and FIG. 3(*b*), FIG. 3(*c*), FIG. 3(*d*), FIG. 3(*e*) and FIG. 3(*f*) are locally expanded view for parts of FIG. 3(*a*)
Figure 4:
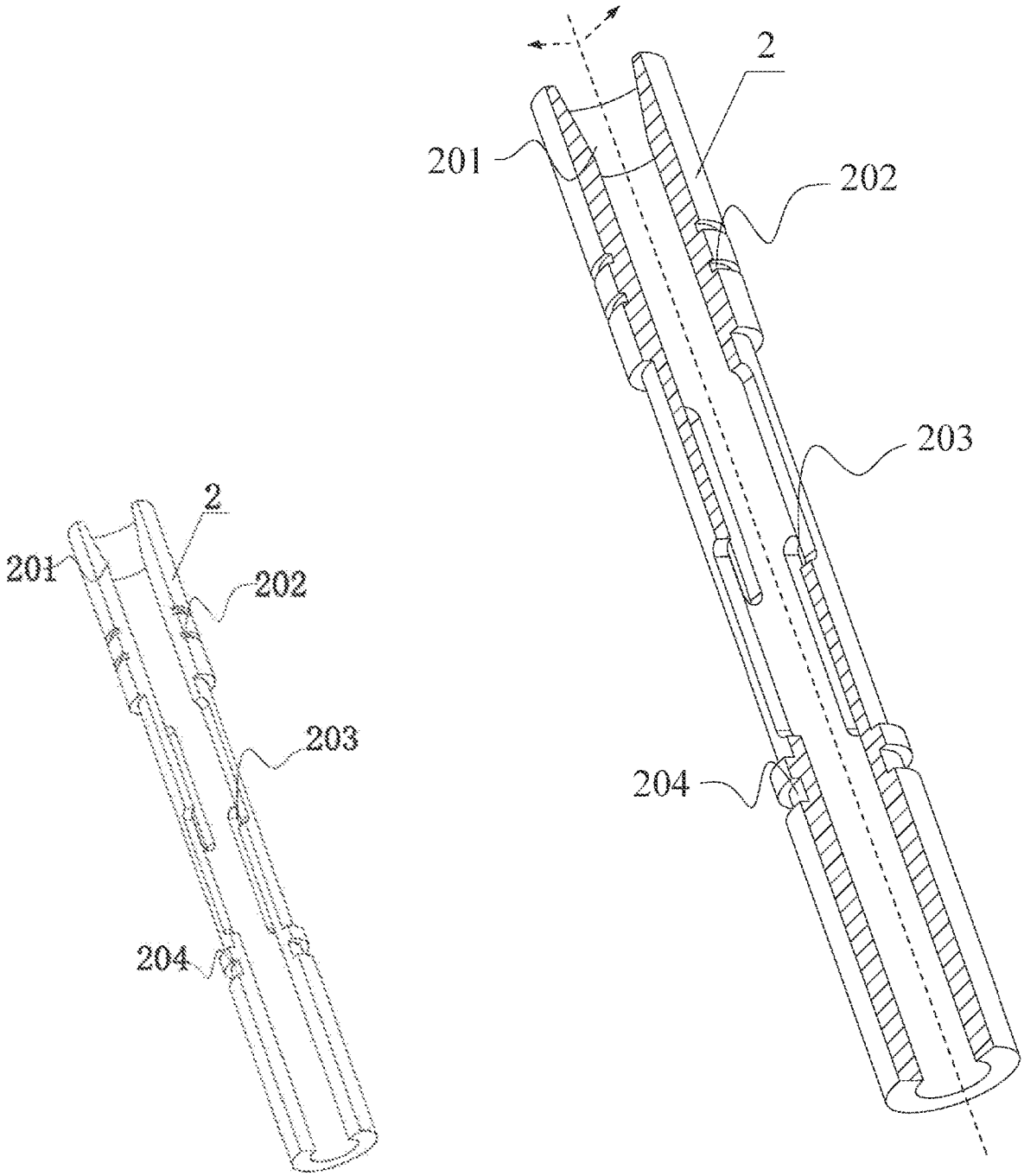
FIG. 4 is a three dimensional view of the coaxial throttle rod in the present disclosure.
Figure 5:
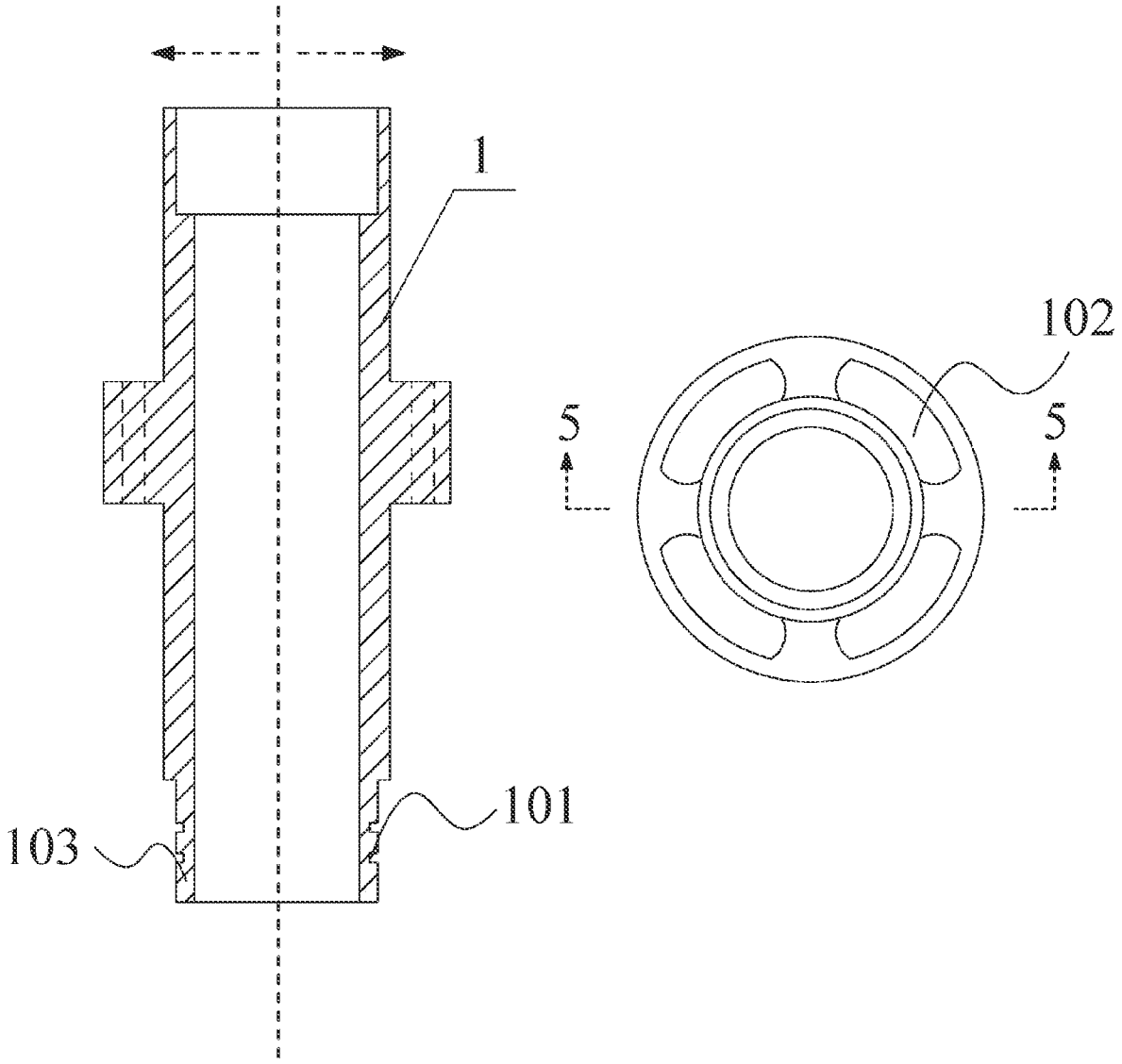
FIG. 5 is a two dimensional view of the inner tube upper joint in the present disclosure.
Figure 6:
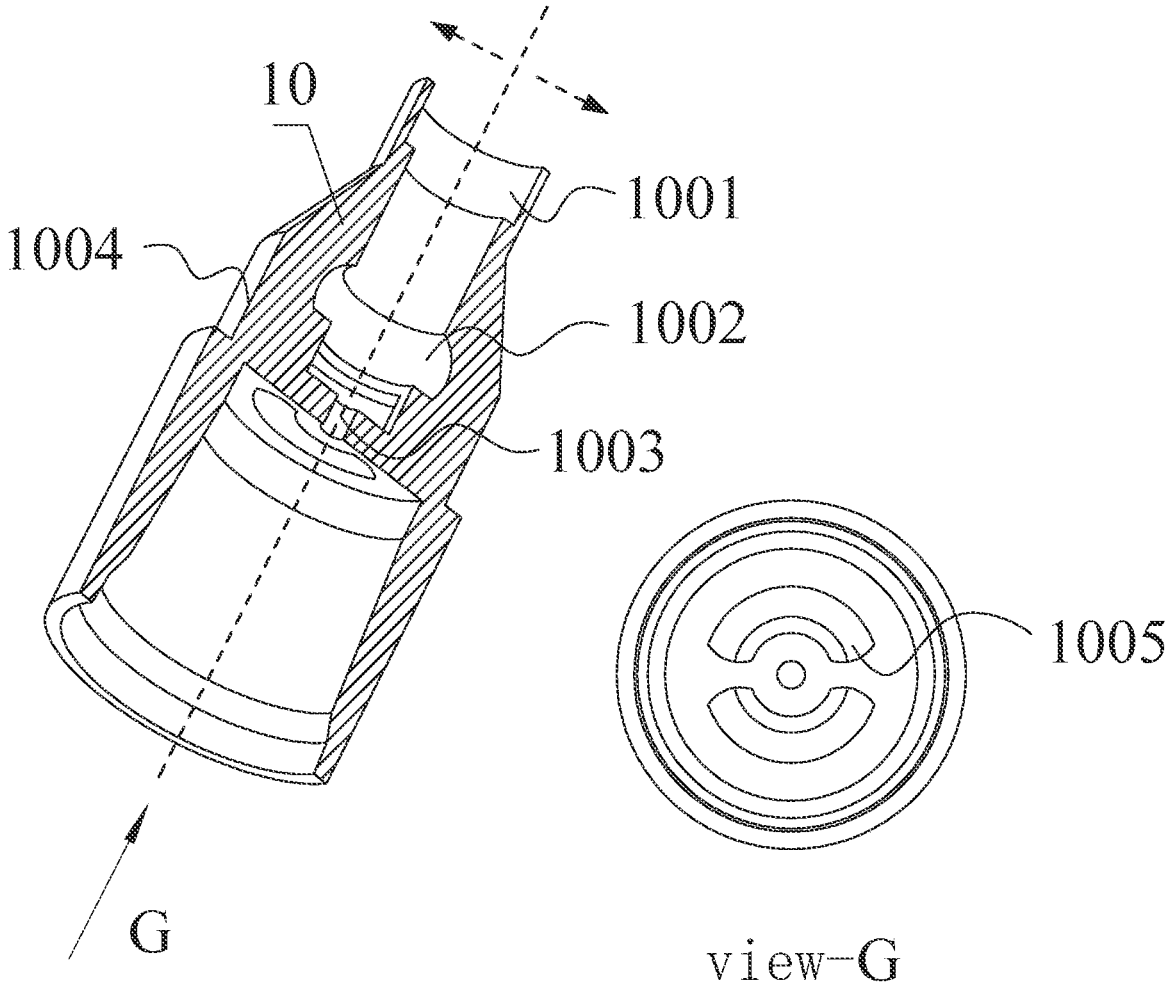
FIG. 6 is a three dimensional view of the inner but lower joint in the present disclosure.
Figure 7:
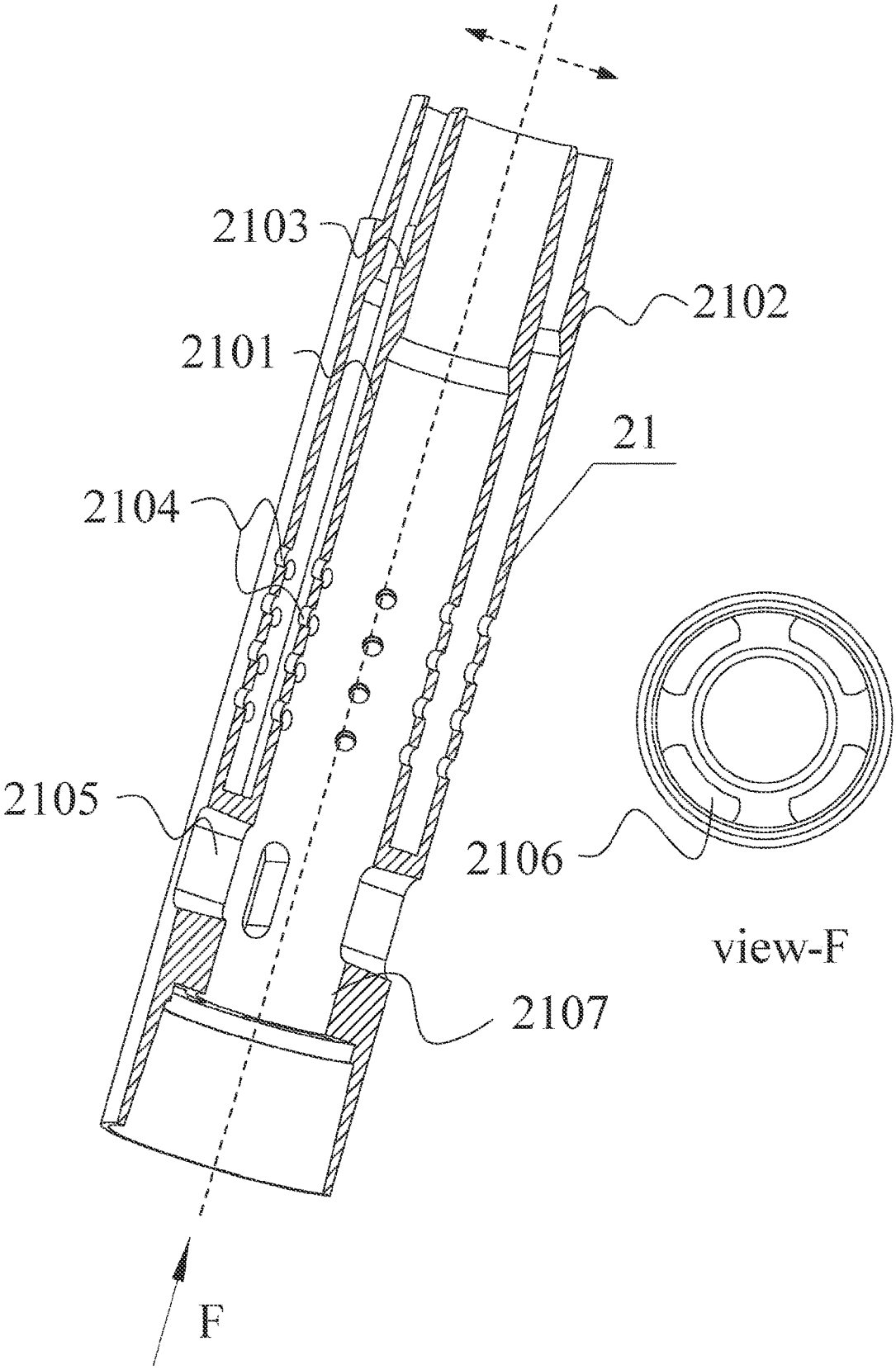
FIG. 7 is a three dimensional view of the outer layer sleeve in the present disclosure.
Figure 8:
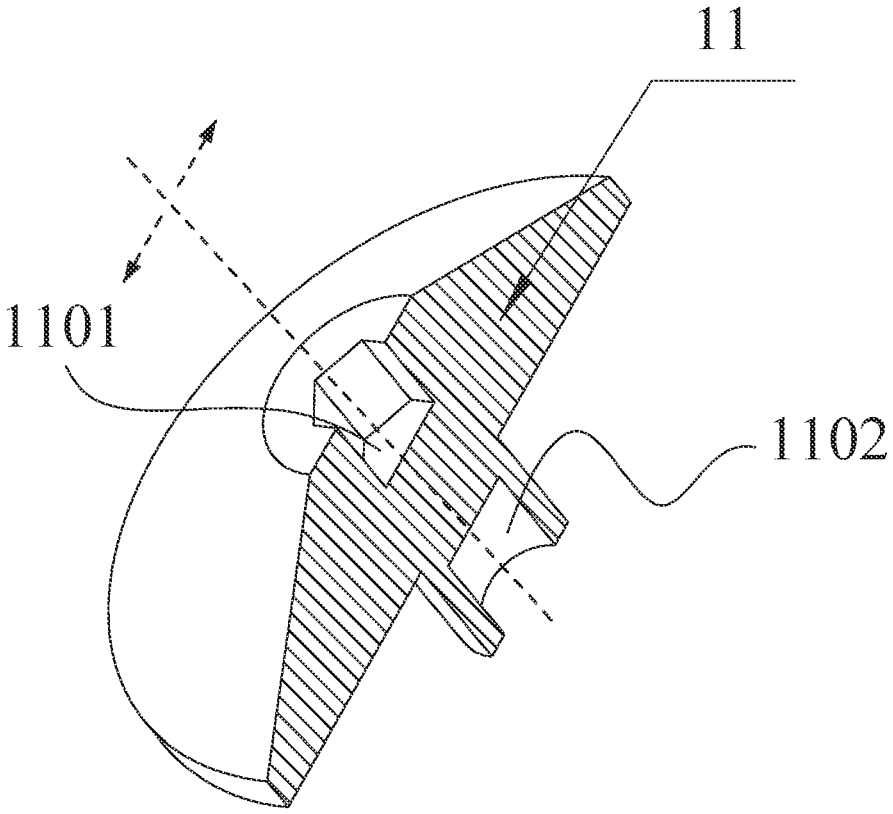
FIG. 8 is a three dimensional view of the poppet valve cover in the present disclosure.

In the drawings: 1 presents the inner tube upper joint, 101 presents the sealing groove I, 102 presents the flow hole I, 103 presents the plug-in male connector I, 2 presents the coaxial throttle rod, 201 presents the throttle port, 202 presents the sealing groove II, 203 presents the long through hole, 204 presents the positioning groove, 3 presents the intermediate sleeve, 301 presents the plug-in female connector I, 302 presents the 25° inclined slot, 303 presents the 30° inclined slot, 304 presents the 40° inclined slot, 305 presents the 50° inclined slot, 306 presents the 60° inclined slot, 307 presents the threaded hole I, 308 presents the threaded hole III, 309 presents the threaded hole IV, 310 presents the sealing groove III, 311 presents the plug-in male connector II, 4 presents the C-shaped ring, 5 presents the jet head, 6 presents the jet head housing I, 7 presents the block I, 8 presents the throttle nozzle I, 9 presents the spring II, 10 presents the inner tube lower joint, 1001 presents plug-in female connector II, 1002 presents the arcuate cavity, 1003 presents the through hole, 1004 presents the outer thread II, 1005 presents the flow channel hole, 11 presents the poppet valve cover, 1101 presents the internal hexagonal groove I, 1102 presents the threaded hole V, 12 presents the spring I, 13 presents the axial rod, 14 presents the jet head housing II, 15 presents the spring III, 16 presents the throttle nozzle II, 17 presents the block II, 18 presents the throttle nozzle III, 19 presents the spring IV, 20 presents the plug, 21 presents outer layer sleeve, 2101 presents the first layer sleeve, 2102 presents the second layer sleeve, 2103 presents the outer thread I, 2104 presents the mounting hole, 2105 presents the suction port, 2106 presents the flow hole II, 2107 represents the inner thread II, 22 presents the supporting ring.

Figure 9:
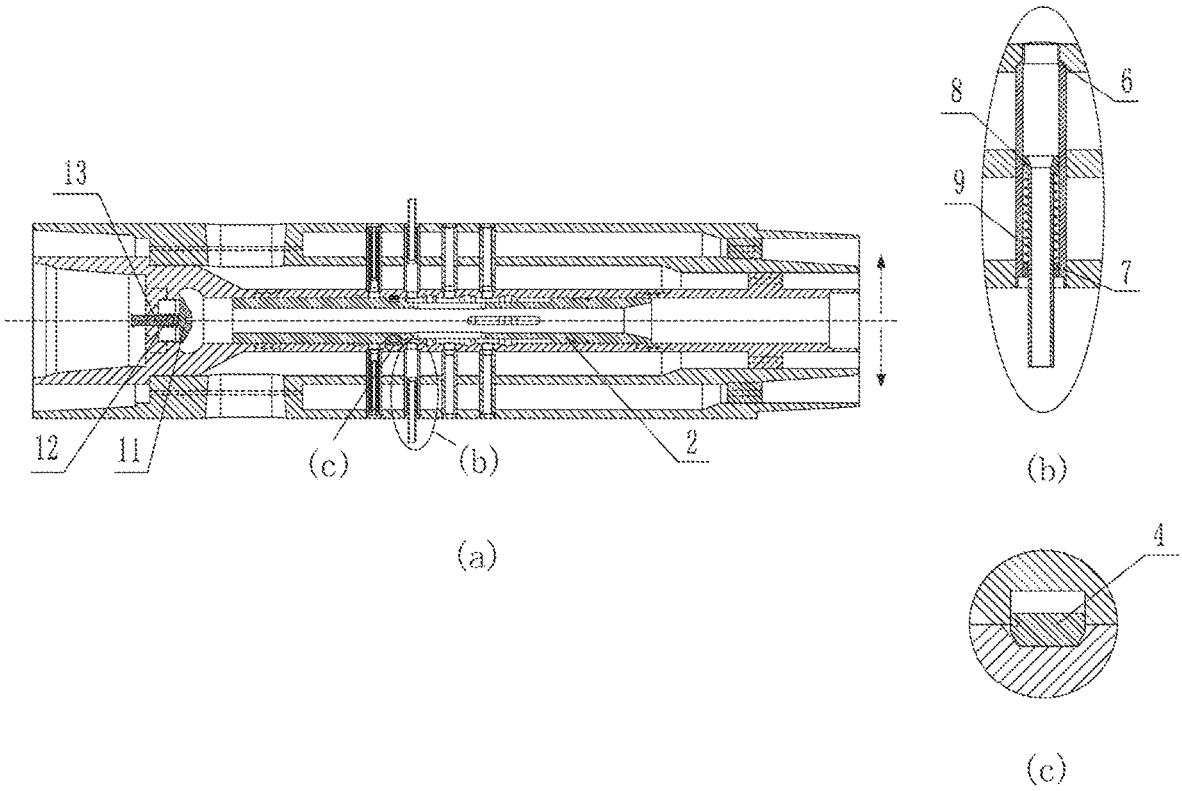
FIG. 9(*a*) is a schematic view of the overall structure under three-stage crushing flow in the present disclosure, and FIG. 9(*b*) and FIG. 9(*c*) are locally expanded view for parts of FIG. 9(*a*)
Figure 10:
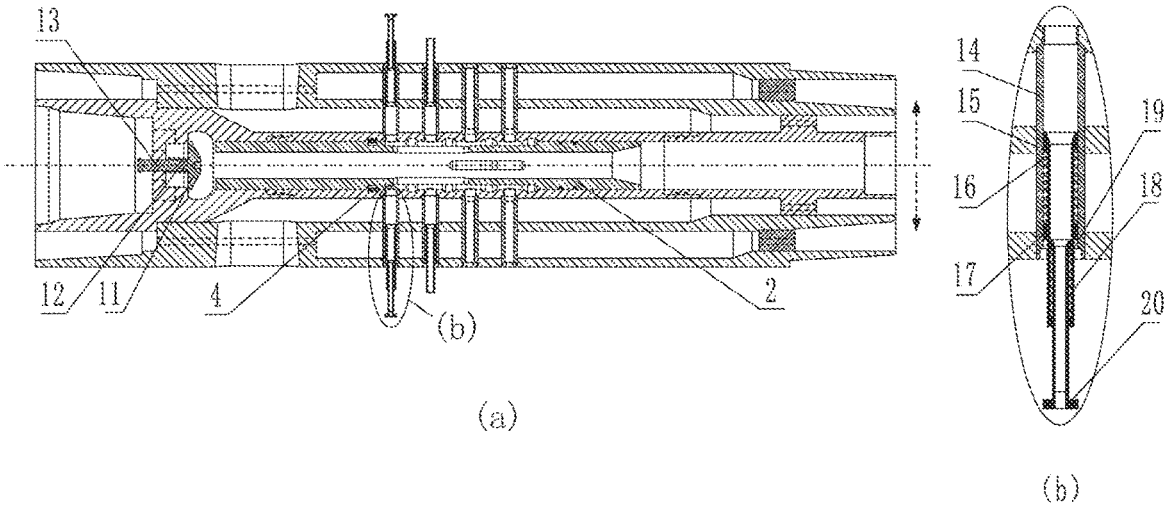
FIG. 10 is a schematic view of the overall structure under four-stage crushing flow in the present disclosure, and FIG. 10(*b*) is a locally expanded view for parts of FIG. 10(*a*)

And Phantom lines FIGS. 1, 9 and 10 are indicative of the flow passages.

DETAILED DESCRIPTION OF PREFERRED EMBODIMENTS

The present invention will be further described below with reference to the drawings: FIGS. 1 to 10 shows a cavity creation tool by crushing with multi-stage controllable water jet for natural gas hydrate development, which comprises the inner tube upper joint 1, the coaxial throttle rod 2, the intermediate sleeve 3, the C-shaped ring 4, the jet head 5, the jet head housing I 6, the block I 7, the spring II 9, the throttle nozzle I 8, the inner tube lower joint 10, the poppet valve cover 11, the spring I 12, the axial rod 13, the outer layer sleeve 21, the jet head housing II 14, the spring III 15, the throttle nozzle II 16, the block II 17, the spring IV 19, the throttle nozzle III 18, the plug 20, the outer layer sleeve 21 and the supporting ring 22.

The axial rod 13 passes through the through hole 1003 and the spring I 12 on the inner tube lower joint 10. The poppet valve cover 11 is put into the arcuate cavity 1002 from the upper portion of the inner tube lower joint 10. The axial rod 13 passes through the spring I 12 and is connected to the poppet valve cover 11 through screw thread connection. The outer layer sleeve 21 is connected to the inner tube lower joint 10 through screw threads. The inner tube lower joint 10 and the intermediate sleeve 3 are in plug-in connection. The position of the intermediate sleeve 3 can be adjusted so that the intermediate sleeve 3 is in plug-in connection between the inner tube upper joint 1 and the inner tube lower joint 10. The supporting ring 22 is connected to the first layer sleeve 2101 of the outer layer sleeve 21 by screw threads; the jet head 5 passes through the mounting hole 2104 on the outer layer sleeve 21 and the jet head 5 is connected to the threaded hole I 307 and the threaded hole II on the intermediate sleeve 3 through screw threads by screwing the internal hexagonal groove on the upper portion of the jet head 5 through a conventional tool such as a wrench.

The throttle nozzle I 8 is disposed in the jet head housing I 6. The spring II 9 is mounted between the throttle nozzle I 8 and the jet head housing I 6. The block I 7 is screwed into the jet head housing I 6 through screw threads. Thus the assembly of the single-stage telescopic jet head is completed. The single-stage telescopic jet head is connected to the threaded hole III 308 on the intermediate sleeve 3 through screw threads by screwing the internal hexagonal groove on the upper portion of the jet head housing I 6 through a conventional tool such as a wrench; The throttle nozzle II 16 is put into the jet head housing II 14. The spring III 15 is mounted between the throttle nozzle II 16 and the jet head housing II 14. The block II 17 is screwed into the jet head housing II 14 through screw threads. The throttle nozzle III 18 is mounted in the throttle nozzle II 16. The spring IV 19 is mounted between the throttle nozzle III 18 and the limiting steps configured in the inner upper end of the throttle nozzle II 16. The plug 20 is connected to the upper portion of the throttle nozzle III 18 through screw threads to fix the throttle nozzle III 18 so as to complete the assembly of the two-stage telescopic jet head. The two-stage telescopic jet head is connected to the threaded hole IV 309 on the intermediate sleeve 3 through screw threads by screwing the internal hexagonal groove on the upper portion of the jet head housing II 14 through a conventional tool such as a wrench. The supporting ring 22 is connected to the first layer sleeve 2101 through screw threads. Thus, the assembly of the cavity creation tool by water jet crushing is completed.

In one embodiment of the present disclosure, the work process of the cavity creation tool by crushing with multi-stage controllable water jet for natural gas hydrate development is as follows:

In the cavity creation tool by crushing with multi-stage controllable water jet for natural gas hydrate development, its upper end is connected to the hydrate separator and its lower portion is connected to the hydraulic drill bit. When the pilot hole drills, the drilling fluid is pumped from the offshore platform, which passes through the inner tube upper joint 1 and the coaxial throttle push rod 2. At this time, the flow of the pumped drilling fluid is not sufficient to produce large enough pushing force at the throttle port 201 of the coaxial throttle push rod 2, so that the C-shaped ring 4 is pushed out from the 25° inclined slot 302. The jet head 5 does not work and the drilling fluid enters the inner tube lower joint 10. The poppet valve cover 11 is subjected to the pushing force produced by the drilling fluid and the function of the spring I 12. The pushing force produced by the drilling fluid in the poppet valve cover 11 is not enough to overcome the resistance of the spring I 12. The drilling fluid flows into the lower hydraulic drill bit through the flow passage hole 1005 in the inner tube lower joint 10, providing power for drilling.

The C-shaped ring 4 is extruded by the intermediate sleeve 3 and deformed until being contracted to the positioning groove 204. The coaxial throttle rod 2 and the C-shape ring 4 are pushed in the axial movement towards the 30° inclined slot 303 along the coaxial throttle rod 2. The C-ring 4 is restored and positioned in the 30° inclined slot 303. The pushing force produced by the drilling fluid of the first level flow in the throttle port 201 is not enough to push out the C-shaped ring 4 from 30° inclined slot 303 while the pushing force produced by drilling fluid of the first level flow in the poppet valve cover 11 overcomes the resistance of the spring I 12. The poppet valve cover 11 moves to the end face of the inner tube lower joint 10 to finish the sealing of the end face. The drilling fluid does not axially flow through the flow passage hole 1005 of the inner tube lower joint 10, during which time the jet head 5 is connected to the drilling fluid passage to start the jet crushing work;

The flow of the drilling liquid pumped from the sea level is increased to the second level flow. The coaxial throttle push rod 2 under second level flow produces bigger pushing force at the throttle port 201 to push the C-shaped ring 4 from the 30° inclined slot 303 into the 40° inclined slot 304. The two rows of jet heads 5 simultaneously performs jet crushing work and forms certain cavity by jet crushing;

The flow is increased to the third level flow again. The coaxial throttle push rod 2 under third level flow produces pushing force at the throttle port 201 to push the C-shaped ring 4 from the 40° inclined slot 304 into the 50° inclined slot 305. The two rows of jet heads 5 simultaneously performs jet crushing work with the single-stage telescopic jet head. The throttle nozzle I 8 is pushed by the drilling fluid and protrudes the jet head housing I 6, performing first hole enlargement work by jet crushing;

The pumped flow is increased to fourth level flow again. The coaxial throttle push rod 2 under fourth level flow produces pushing force at the throttle port 201 to push the C-shaped ring 4 from the 50° inclined slot 305 into the 60° inclined slot 306. The jet head 5, the single-stage telescopic jet head and the two-stage telescopic jet head all are initiated to perform jet crushing work. The throttle nozzle II 6 and the throttle nozzle III 8 are pushed by the drilling fluid and protrude the jet head housing II 14, performing second hole enlargement work by jet crushing;

In the crushing state under the third level flow rate and the fourth level flow, as jet crushing performed by the jet head 5 of the single-stage telescopic jet head and the two-stage telescopic jet head is bound to form a certain cavity, during the pull-back process of the crushing device, the single-stage telescopic jet head and the two-stage telescopic jet head can effectively protrude from the cavity and perform the hole enlargement work rather than get blocked by soils and sands. The crushed natural gas hydrate mixture is inhaled from the suction port 2105 on the outer layer sleeve 21. The passage between the first layer sleeve 2101 and the intermediate sleeve 3 is lifted to the separator. After separated by the separator, soils and sands pass the passage between the first layer sleeve 2101 and the second layer sleeve 2102 through the flow hole 2106 and are transported to sand discharge port of the drill end, which realizes the backfill of soils and sands in situ.

What is claimed is:

1. A cavity creation tool by crushing with multi-stage controllable water jet for natural gas hydrate development consisting of an inner layer structure, an outer layer structure and a jet crushing structure;

wherein the inner layer structure consists of an inner tube upper joint (1), an inner tube lower joint (10), an intermediate sleeve (3) mounted between the inner tube upper joint (1) and the inner tube lower joint (10) through a plug-in connection, a C-shaped ring (4), a coaxial throttle push rod (2) and a sealing structure with a poppet valve end face;

wherein, the intermediate sleeve (3) is provided with a plug-in female connector I (301), a 250 inclined slot (302), six threaded holes I (307) distributed evenly along a circumference of the intermediate sleeve, a 300 inclined slot (303), six threaded holes II (312) distributed evenly along a circumference of the intermediate sleeve, a 400 inclined slot (304), six threaded holes III (308) distributed evenly along a circumference of the intermediate sleeve, a 500 inclined slot (305), six threaded holes IV (309) distributed evenly along a circumference of the intermediate sleeve, a 600 inclined slot (306), a sealing groove III (310) and a plug-in male connector II (311);

the C-shaped ring (4) is mounted on the coaxial throttle push rod (2) to realize the axial and radial positioning of the coaxial throttle push rod (2) in the intermediate sleeve (3), the sealing structure with a poppet valve end face comprises a poppet valve cover (11), a spring I (12) and an axial rod (13), the axial rod (13) is connected to the poppet valve cover (11) and the spring I (12) through screw threads and mounted to the inner tube lower joint (10); the outer layer structure consists of the outer layer sleeve (21) and the supporting ring (22), the outer layer sleeve (21) is provided with a first layer sleeve (2101), a second layer sleeve (2102), an outer thread I (2103) located at the upper portion of the first layer sleeve (2101), an inner thread II (2107) located at the lower portion of the first layer sleeve (2101), four evenly distributed suction ports (2105) located at the lower portion of the outer layer sleeve (21) and penetrating through the first layer sleeve (2101) and the second layer sleeve (2102), evenly distributed mounting holes (2104) located at the lower portion of the outer layer sleeve (21) and penetrating through the first layer sleeve (2101) and the second layer sleeve (2102) and four evenly distributed flow holes II (2106) located between the first layer sleeve (2101) and the second layer sleeve (2102);

wherein, the supporting ring (22) is connected to the upper portion of the first layer sleeve (2101) through screw threads to realize a mutual fixation between the first layer sleeve (2101) and the second layer sleeve (2102);

the jet crushing structure consists of a jet head (5), a single-stage telescopic jet head and a two-stage telescopic jet head;

wherein, the jet head (5) is mounted within a threaded hole I (307) and a threaded hole II (312), the single-stage telescopic jet head is mounted on a threaded hole III (308), the two-stage telescopic jet head is mounted on a threaded hole IV (309);

the single-stage telescopic jet head consists of a jet head housing I (6), a spring II (9), a throttle nozzle I (8) and a block I (7), the outer wall of the block I (7) is provided with outer screw threads, the block I (7) is connected within the jet head housing I (6) through the outer screw threads of the block I, the spring II (9) is mounted between the throttle nozzle I (8) and the jet head housing I (6); the two-stage telescopic jet head consists of a jet head housing II (14), a spring III (15), a throttle nozzle II (16), a spring IV (19), a throttle nozzle III (18), a plug (20) and a block II (17), the outer wall of the block II (17) is provided with outer screw threads, the block II (17) is connected within the jet head housing II (14) through the outer screw threads of the block II, the spring III (15) is mounted between the throttle nozzle II (16) and the jet head housing 11 (14), the spring IV (19) is mounted between the throttle nozzle III (18) and limiting steps configured on an end of the throttle nozzle II (16).

2. The cavity creation tool by crushing with multi-stage controllable water jet for natural gas hydrate development according to claim 1, wherein the lower portion of the inner tube upper joint (1) is provided with a sealing groove I (101) and a plug-in male connector I (103), and the upper end of the inner tube upper joint (1) is provided with a flow hole I (102).

3. The cavity creation tool by crushing with multi-stage controllable water jet for natural gas hydrate development according to claim 1, wherein an inside of the inner tube lower joint (10) is provided with an arcuate cavity (1002), a flow channel hole (1005) and a through hole (1003), the upper end of the inner tube lower joint (10) is provided with a plug-in female connector II (1001), the lower end of the inner tube lower joint (10) is provided with an outer thread II (1004).

4. The cavity creation tool by crushing with multi-stage controllable water jet for natural gas hydrate development according to claim 1, wherein the upper portion of the poppet valve cover (11) is provided with an internal hexagonal groove I (1101), and the lower part of the poppet valve cover (11) is provided with a threaded hole V (1102).

* * * * *